US005094002A

United States Patent [19]

Saunders

[11] Patent Number: 5,094,002

[45] Date of Patent: Mar. 10, 1992

[54] ARCHERY SIGHT

[75] Inventor: Charles A. Saunders, Columbus, Nebr.

[73] Assignee: Saunders Archery, Columbus, Nebr.

[21] Appl. No.: 753,147

[22] Filed: Aug. 30, 1991

[51] Int. Cl.[5] ..... F41G 1/00

[52] U.S. Cl. ..... 33/265; 33/241

[58] Field of Search ..... 33/265, 241, 242, 243, 33/233; 124/87

[56] References Cited

U.S. PATENT DOCUMENTS 2,610,405 9/1952 Dickinson ..... 33/243
2,706,335 4/1955 Munsey ..... 33/241
3,184,851 5/1965 Simmons .
4,166,324 9/1979 Carollo et al. .
4,495,705 1/1985 Kowalski et al. .
4,584,777 4/1986 Saunders ..... 33/265

*Primary Examiner*—Harry N. Haroian

[57] ABSTRACT

An archery sight construction (10) including a generally T-shaped light gathering sight element (13) having a stem (17) which is engaged in a recess (15) in a support post member (14). The stem (17) and the recess (15) are provided with at least one planar laterally abutting surface to prevent the rotation of the stem (17) relative to the recess (15).

4 Claims, 1 Drawing Sheet

FIG. 1
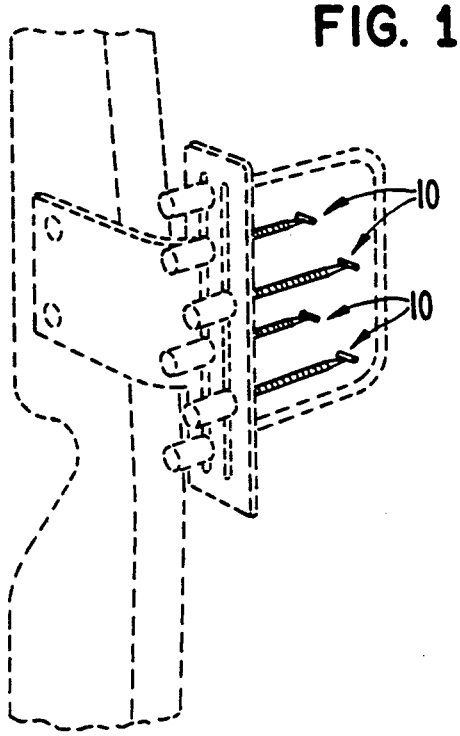
FIG. 2
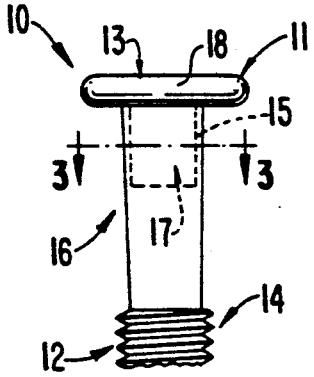
FIG. 6
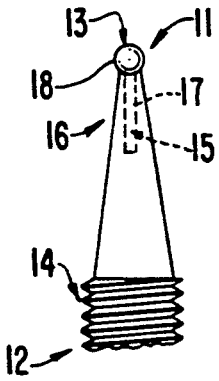
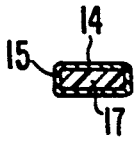
FIG. 3
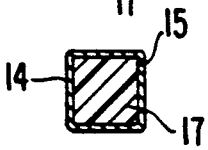
FIG. 4
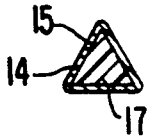
FIG. 5
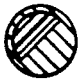
FIG. 7

ARCHERY SIGHT

TECHNICAL FIELD

The present invention relates to the field of archery sights in general, and in particular to a new type of archery sight pin construction that will preclude relative rotation between the sight member and the supporting pin member.

BACKGROUND ART

This application contains related subject matter to co-pending patent application Ser. No. 07/330,002 filed on Mar. 29, 1989 now abandoned, and entitled "Sight", the content of which is incorporated herein by reference.

As can be seen by reference to the following U.S. Pat. Nos. 3,184,851; 4,166,324; and 4,495,705, the prior art is replete with myriad and diverse sight constructions for both guns and bows.

While all of the aforementioned prior art constructions are more than adequate for the basic purpose and function for which they have been specifically designed, these prior art devices are woefully inadequate in preventing the relative rotation between the sight element and the support post member.

When the subject matter of the above cited co-pending patent application was first introduced into the marketplace, it received an overwhelmingly enthusiastic reception among both target and bow hunting archers. The enthusiastic reception was due to the fact that this particular sight was the first of its kind available to archers that would provide the low light gathering capability available to gun hunters by using an elongated cylindrical light gathering bead such as disclosed in U.S. Pat. No. 3,184,851.

In fact, this particular sight construction was so popular that it generated the highest degree of flattery. Within a year or two of the first appearance of the sight in the marketplace, at least one other archery company began producing an almost identical copy of the sight construction.

However, subsequent to those events, it recently became apparent that due to the relatively soft deformable nature of the BUTARATE plastic employed in the sight element coupled with the rigid metallic nature of the support post member, the sight element over a period of time would rotate somewhat freely relative to the support post element which rendered the sight virtually useless for its intended purpose and function, inasmuch as the cylindrical light gathering sight element would naturally tend to orient its longitudinal axis in a vertical as opposed to generally horizontal disposition.

As a consequence of the foregoing situation, there has existed a recent need among users of T-bar configured light gathering sight elements for a new type of construction that will virtually eliminate the possibility of the T-bar sight element to rotate relative to the support post member. The provision of such a construction is a stated objective of the present invention.

DISCOURSE OF THE INVENTION

Briefly stated, the improved sight construction that forms the basis of the present invention comprises a T-bar type light gathering sight element having a specific stem configuration coupled with a support post element which threadably engages a conventional sight pin mounting bracket on one end and whose other end is provided with a complimentary contoured recess that is dimensioned to receive the stem of the light gathering sight element and further immobilize the stem of the light gathering sight element relative to the support post member from a rotational standpoint.

As will be explained in greater detail further on in the specification, the stem of the light gathering sight element is provided with multi-planar peripheral surfaces. The mounting recess in the support post member is provided with complimentary multi-planar interior surfaces which abut the peripheral surfaces of the stem of the sight element to prevent the sight element from rotating relative to the support post member.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of a plurality of T-bar type sight pins disposed in a conventional archery sight hunting bracket;

FIG. 2 is an isolated end view of the sight construction as seen from the top;

FIGS. 3 through 5 are enlarged cross-sectional views taken through line 3—3 of FIG. 2;

FIG. 6 is an isolated end view of the preferred embodiment of the invention as seen from the side; and FIG. 7 is an alternate version of the preferred embodiment employing a semi-circular stem and recess.

BEST MODE FOR CARRYING OUT THE INVENTION

As can be seen by reference to the drawings, and in particular to FIGS. 1 through 3, the archery sight construction that forms the basis of the present invention is designated generally by the reference numeral (10). The sight construction (10) that forms the basis of the present invention comprises in general a sight unit (11) and a pin support unit (12). These units will now be described in seriatim fashion.

As is the case with the commercially available light gathering sight pin constructions offered by Saunders Archery Co. and Cobra Mfg. Inc., the basic sight pin construction (10) comprises a sight unit (11) including a generally T-shaped light gathering sight element (13) fabricated from BUTARATE plastic, or the like. A pin support unit (12) including an elongated threaded support post member (14) having a central recess (15) formed on one end (16) which is dimensioned to receive the stem (17) of the light gathering sight element (13).

Furthermore, the light gathering sight element (13) also includes a conventional generally elongated cylindrical light bar (18). Light bar (18) serves as the crossarm at the top of the generally T-shaped light gathering sight element (13).

Turning now to the preferred embodiment of the invention depicted in FIGS. 2, 3 and 6, it can be seen that the main distinctions between the conventional sight constructions and the present invention comprise the multi-planar configuration of both the interior walls of the recess (15) in the support post member (14) and the multi-planar external periphery of the stem (17) of the light gathering sight element (13).

Still referring to FIGS. 2, 3, and 6, it can be seen that in the preferred embodiment of the invention, the stem

(17) has a generally elongated flat rectangular configuration. The interior of the recess (15) also defines a like dimensioned generally flat rectangular recess (15) dimensioned to receive the stem (17) of the light gathering sight element (13), such that the light bar (18) is disposed proximate the outboard end (16) of the support post member (14).

In addition, as is clearly shown in FIGS. 2 and 3, the outboard end (16) of the support post member (14) has a generally slim inwardly tapered profile as viewed from the side while having a generally wide outwardly tapered profile as viewed from the top.

As can also be seen by reference to FIGS. 4 and 5, this invention also contemplates the use of other multi-planar recess (15) and stem (17) configurations which include, but are not limited to, squares, triangles, etc.

It should further be noted by reference to FIG. 7, that while this invention has thus far been described in terms of multi-planar engagements between the recess (15) and stem (17), a single planar engagement between the stem (17) and recess (15) such as the semi-circular configuration would also serve to produce the same desired result.

Having thereby described the subject matter of the present invention, it should be apparent that many substitutions, modifications and variations of the present invention are possible in light of the above teachings. It is therefore to be understood that the invention as taught and described herein is only to be limited to the extent of the breadth and scope of the appended claims.

I claim:

1. An improved sight construction for use on bows wherein the sight construction comprises:

a generally T-shaped light gathering sight element having a stem which supports an elongated light bar; and an elongated threaded support post member having a central recess formed on one end and dimensioned to receive said stem, the central recess and the stem each have at least one planar surface that may be disposed in a lateral abutting relationship relative to one another to prevent relative rotation between said sight element and said support post member.

2. The sight construction as in claim 1 wherein said stem and said recess are provided with multi-planar external and internal surfaces respectively that may be disposed in a lateral abutting relationship relative to one another.

3. The sight construction as in claim 2 wherein said one end of said post member has an inwardly tapered profile when viewed from an end-on relationship relative to said light bar.

4. The sight construction as in claim 3 wherein said one end of said post has an outwardly tapered profile when viewed from the side of the light bar.

* * * * *